United States Patent [19]

Bugler, III

[11] Patent Number: 4,700,893

[45] Date of Patent: Oct. 20, 1987

[54] MULTIPURPOSE NON-CLOGGING NOZZLE FOR WATER COOLING TOWERS

[75] Inventor: Thomas W. Bugler, III, Prairie Village, Kans.

[73] Assignee: The Marley Cooling Tower Company, Mission, Kans.

[21] Appl. No.: 889,479

[22] Filed: Jul. 25, 1986

[51] Int. Cl.[4] ..... B05B 1/26

[52] U.S. Cl. ..... 239/498; 239/500; 239/518

[58] Field of Search ..... 239/498, 500, 518, 524; 169/37, 38, 39, 40, 41

[56] References Cited

U.S. PATENT DOCUMENTS

| | | | |
|---|---|---|---|
| 453,055 | 5/1891 | Ware . | |
| 458,607 | 9/1891 | Weiss . | |
| 540,864 | 6/1895 | Lewis . | |
| 1,113,666 | 9/1978 | DeWitte . | |
| 1,286,333 | 12/1918 | Johnson | 239/524 X |
| 1,381,734 | 6/1921 | Parker et al. . | |
| 1,597,715 | 8/1926 | Blackburn . | |
| 1,658,533 | 2/1928 | Mart . | |
| 1,710,832 | 4/1929 | Mart . | |
| 1,784,019 | 12/1930 | Mart . | |
| 1,836,505 | 12/1931 | Pritchard . | |
| 1,877,046 | 9/1932 | Phillips . | |
| 2,005,600 | 6/1935 | Tappen . | |
| 2,375,528 | 5/1945 | De Flon . | |
| 2,550,456 | 4/1951 | De Flon . | |
| 2,697,008 | 12/1954 | Rowley . | |
| 2,877,778 | 3/1959 | Kirby . | |
| 3,533,560 | 10/1970 | Meek . | |
| 3,603,512 | 9/1971 | Ham . | |
| 3,617,036 | 11/1971 | Brown . | |
| 3,768,736 | 11/1973 | Cox . | |
| 4,099,675 | 7/1978 | Wohler et al. . | |
| 4,208,359 | 6/1980 | Bugler . | |
| 4,333,749 | 6/1982 | Holmberg et al. . | |
| 4,501,708 | 2/1985 | Shepherd | 239/500 X |

FOREIGN PATENT DOCUMENTS 499856 10/1928 Fed. Rep. of Germany .

*Primary Examiner*—Andres Kashnikow
*Assistant Examiner*—Patrick N. Burkhart
*Attorney, Agent, or Firm*—Schmidt, Johnson, Hovey & Williams

[57] ABSTRACT

A multiple-purpose, non-clogging target-type water distribution nozzle assembly for use in counterflow or crossflow water cooling towers is provided which is sized to safely clear large debris found in some cooling water while giving relatively full coverage water dispersal for enhanced water cooling. The preferred nozzle assembly includes a water metering upper section having a tubular flow conduit for substantially axial, downward water flow. A target is situated below the conduit and includes a central, essentially conical ramp-like element, and a plurality of elongated, outwardly extending, transversely arcuate water-dispersing fingers oriented in a circular array around the base of the ramp-like element. Hot water is initially passed downwardly through the conduit for impingement on the target structure, which serves to create a relatively even dispersal of water over a large area beneath the target, thus enhancing cooling of the water. The target metering section and structure are cooperatively sized and strategically located so as to safely pass relatively large debris found in some cooling waters.

11 Claims, 12 Drawing Figures

Fig.1.
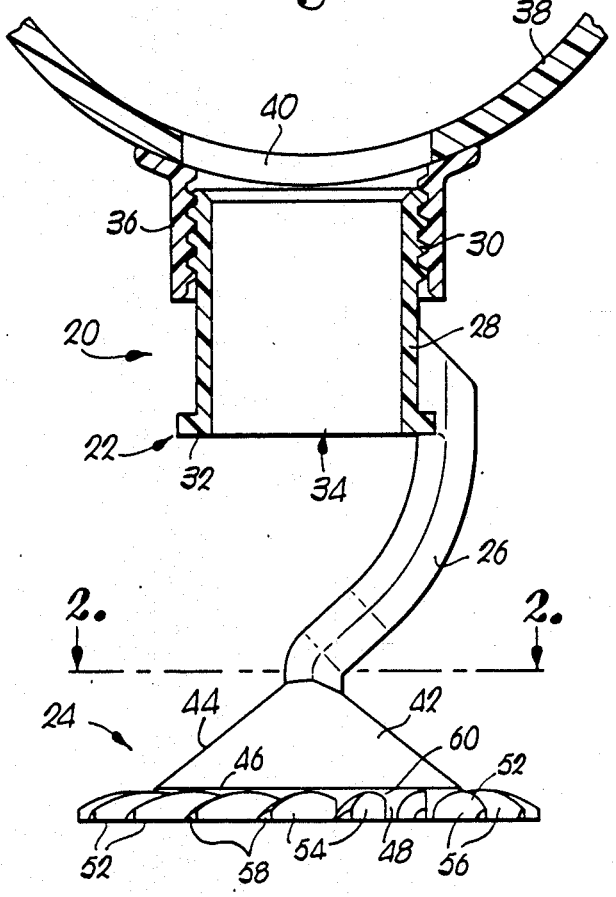
Fig.5.
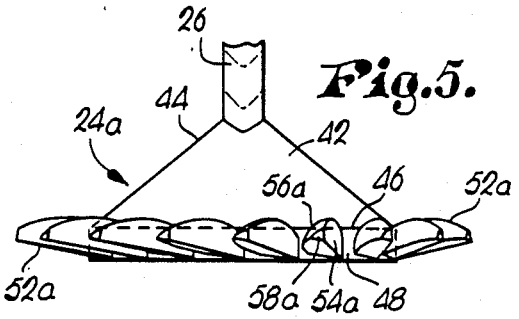
Fig.4.
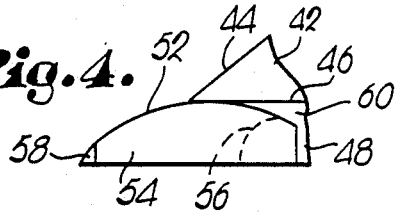
Fig.6.
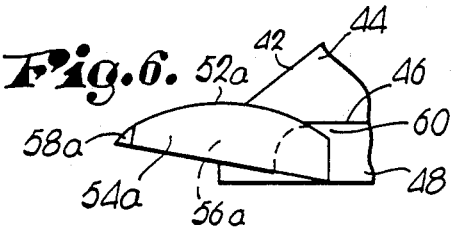
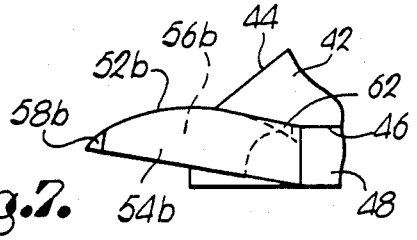
Fig.7.
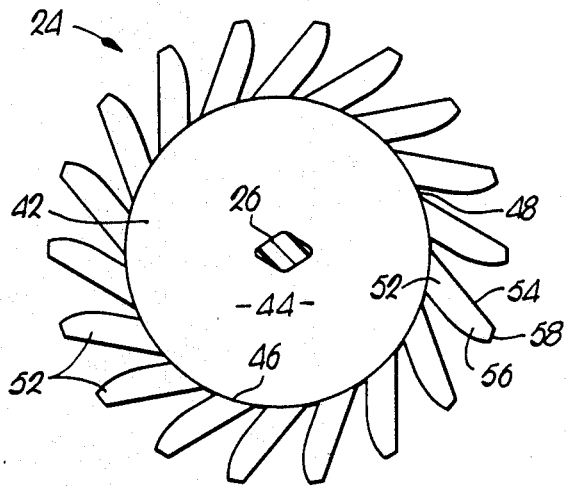
Fig.2.
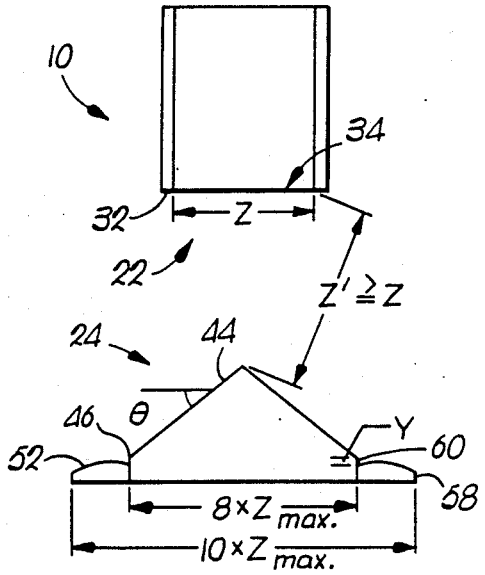
Fig.3.

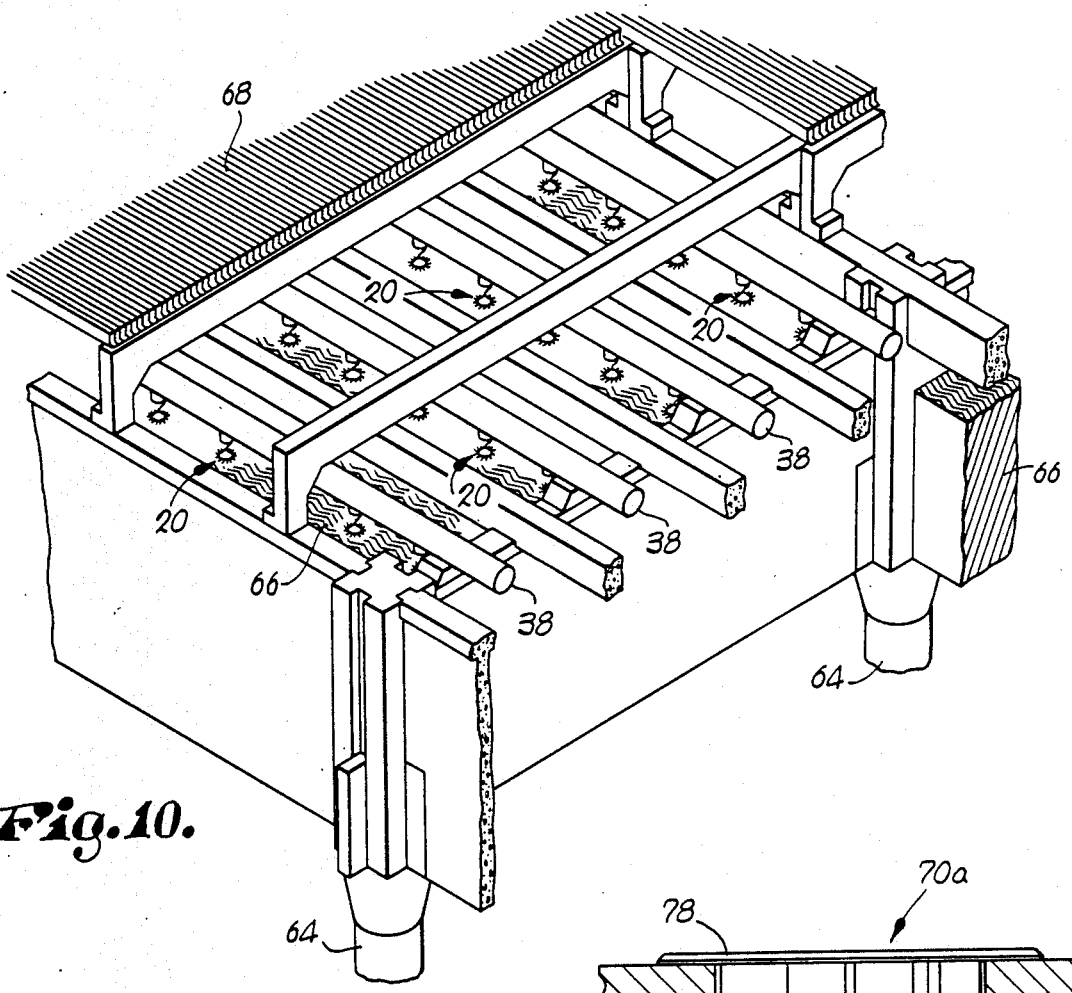
Fig. 10.
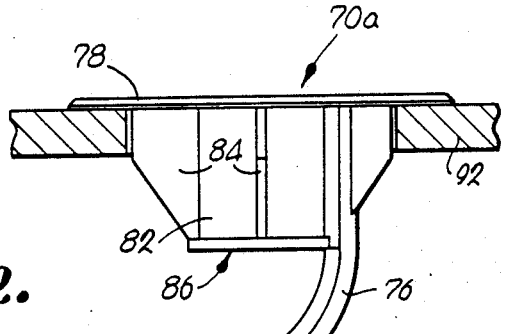
Fig. 12.
Fig. 11.
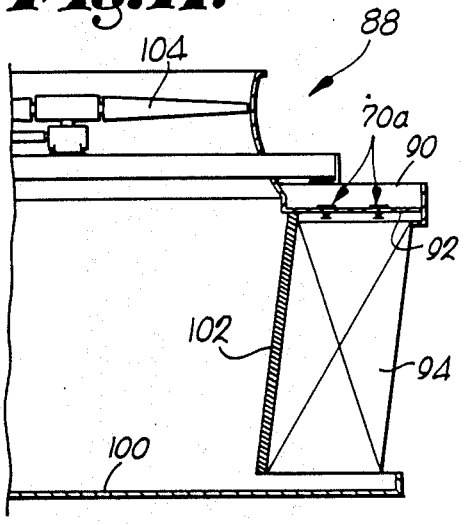
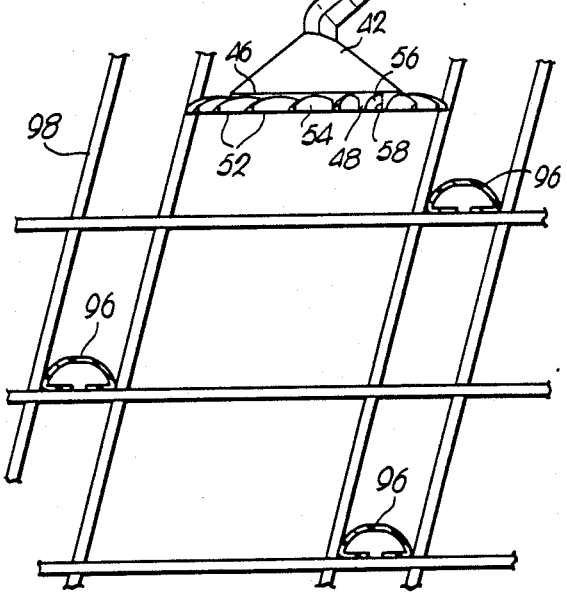

MULTIPURPOSE NON-CLOGGING NOZZLE FOR WATER COOLING TOWERS

BACKGROUND OF THE INVENTION

1. Field of the Invention

The present invention is broadly concerned with a liquid distribution nozzle assembly which can be used to good effect in both counterflow and crossflow-type water cooling towers, and which is designed to safely pass relatively large particles and debris found in some cooling water streams while at the same time giving excellent water dispersal for enhanced cooling. More particularly, it is concerned with such a distribution nozzle assembly making use of an axial flow type water metering fixture together with a specially designed, strategically located target structure beneath the fixture designed to effectively break up and disperse impinging water into relatively small droplets over the area beneath and surrounding the nozzle for the most effective distribution for cooling of the water.

2. Description of the Prior Art

Electrical utilities and other types of large scale industrial plants generally employ water cooling towers handling the large quantities of hot water produced during plant operations. In towers of the crossflow variety, hot water is delivered to an elevated distribution basin, whereupon the hot water is permitted to gravitate therefrom through a series of orifices into a fill section and, ultimately, collection in a lower cold water basin. As the water gravitates through the fill section, ambient-derived air is drawn laterally through the fill in order to come into intersecting relationship with the hot water. It has long been the standard procedure with such crossflow towers to provide removable tubular nozzles in the distributor floor apertures. These nozzles are generally fabricated of corrosion resistant materials, and are provided with a central cylindrical body section which extends downwardly through a basin aperture and a relative large upper flange adapted to rest flatly on the floor of the basin around the aperture. Moreover, such nozzles are conventionally provided with a target structure beneath the tubular fittings which are designed to break up and disperse the gravitating water.

Another type of commonly employed tower is referred to as a counterflow tower. In such units, initially hot water is passed downwardly through the fill structure, while ambient-derived cooling air is brought upwardly through the fill in direct opposition to the descending water. As a consequence of this design, counterflow towers do not make use of overlying basins as such, but instead are provided with piping systems and associated outlet nozzles in overlying relationship to the fill structure.

U.S. Pat. No. 3,617,036 discloses a highly effective nozzle apparatus designed for use in crossflow-type cooling towers. The nozzle disclosed in this patent includes the described tubular fitting creating a downwardly directed, metered flow of water onto an underlying target device. However, nozzles as disclosed in this patent are not suited for use in counterflow-type towers.

On the other hand, U.S. Pat. No. 4,208,359 describes a very successful distribution nozzle specifically designed for counterflow towers. In this device a hollow-cone swirl-type upper nozzle is provided along with a lower target in the form of a plurality of circularly arranged buttons or fingers oriented for water dispersal purposes. Here again, nozzles as disclosed in this patent are extremely effective in the context of counterflow towers, but cannot be used in crossflow towers because of the need to create a hollow-cone swirl pattern, rather than providing a simple tubular fitting for axial water flow.

The counterflow-type nozzles described in U.S. Pat. No. 4,208,359 are designed for use in pairs with adaptors which straddle piping on five to six foot centers. Many existing counterflow towers, however, are piped on two and one-half to three foot centers, and are not provided with lateral distribution pipes designed to mate with the tangential tubular entryways forming a part of the upper swirltype nozzle bodies. Rather, such prior constructions simply include a plurality of parallel, spaced apart mains with depending, threaded nipples on two and one-half to three foot centers. As can be appreciated, in order to convert such prior counterflow towers to use nozzles of the type described in U.S. Pat. No. 4,208,359, considerable work and repiping is required, and this can amount to a significant expense.

In the operation of a plant water cooling system, it is a common practice to periodically place a number of foamed plastic or cellular synthetic rubber-like balls into the cooling water in order to clean and clear out plant heat exchange tubes. The balls are sized to be slightly larger in diameter than the pipes through which they are passed for cleaning purposes, and are generally available in diameters ranging from about one-half inch up to about one and one-half inches. Given this practice, it is important that water cooling towers, and particularly the nozzles forming a part thereof, be constructed so as to accommodate flow of such balls therethrough. Even though the cleaning balls are designed to be removed after each use thereof, it normally follows that a number of the balls escape and remain in the system; hence the need to provide clearances for such balls.

Another related problem stems from the fact that many cooling waters, such as those taken directly from rivers, contain significant amounts of debris. In certain cases clams and crabs can also be taken up in the cooling water delivered to the tower, and as a consequence the distribution nozzle must also be able to safely accommodate debris of this type without clogging.

SUMMARY OF THE INVENTION

The present invention overcomes the problems noted above, and provides a greatly improved, multi-purpose nozzle assembly which can be used to good effect in both crossflow and conventionally piped counterflow towers, while giving essentially equivalent cooling performance as compared with the nozzles described in the aforementioned patents. At the same time, the nozzle assembly of the invention is sized to easily accommodate large debris such as clams or the like found in some cooling waters.

Broadly speaking, the distribution nozzle assembly of the present invention includes water metering means having structure presenting a water metering orifice of predetermined diameter, along with means for delivery of water in a generally axial, downwardly extending manner from the metering orifice. Means is provided below the metering orifice for dispersing and increasing the effective surface area of the delivered water, in order to enhance cooling of the latter. This water-dispersing means advantageously includes a dispersing element having an upstanding, downwardly and outwardly diverging, generally conical water-contacting upper surface. This element moreover presents an outer, lower, generally circular in plan configuration marginal edge. The diameter of the water contacting element at the outer marginal edge thereof is preferably greater than the orifice diameter at a minimum, and up to about eight times the diameter of the metering orifice. Moreover, the angle of inclination of the conical water-contacting surface, at the area thereof immediately above the marginal edge of the element, should be from about thirty to about forth-five degrees with respect to the horizontal.

The target structure below the metering means also includes a plurality of elongated, stationary, water-dispersing members each having an elongated, arcuate in cross section water-engaging surface. These members or fingers are mounted adjacent to and extending outwardly from the lower marginal edge of the conical element and are oriented in a substantially circular array. The longitudinal axis of each of the members lies in a vertical plane intersecting the circle defined by the element marginal edge, with such planes being nonradial, i.e., the planes do not pass through the center of the circle defined by the element marginal edge.

In addition, the respective water dispersing members (which are of identical configuration) have respective outer ends which cooperatively define a circle having a relatively large diameter. This diameter is up to about ten times greater than the diameter of the metering orifice.

These relatively critical design features have been found to yield a very effective water dispersal pattern. Indeed, use of distribution nozzles in accordance with the invention produces water dispersal over a relatively large area beneath and around the nozzle, so as to give very efficient cooling of the water.

The nozzle assembly of the invention can be used to good effect in both counterflow and crossflow towers. Moreover, the axial flow design of the upper section of the nozzle permits use thereof on existing counterflow towers having conventional piping systems, while nevertheless improving the cooling efficiency of such towers. Finally, the nozzle can be readily sized for clearing all normally encountered cooling water debris.

BRIEF DESCRIPTION OF THE DRAWINGS

FIG. 1 is a fragmentary view in partial vertical section illustrating a nozzle assembly in accordance with the invention affixed to a conventional piping main forming a part of a counterflow water cooling tower;

FIG. 2 is a sectional view taken along line 2—2 of FIG. 1, and illustrating in detail the lower target structure forming a part of the nozzle assembly;

FIG. 3 is a schematic representation of the components of the nozzle assembly, with certain dimensional relationships between such components being illustrated;

FIG. 4 is a fragmentary view illustrating in detail one of the elongated water-dispersing fingers or members forming a part of the target structure of the assembly of FIGS. 1 and 2;

FIG. 5 is a fragmentary view depicting the lower target structure of another embodiment of the invention, wherein the respective water-dispersing fingers are each oriented at a small angle relative to the horizontal;

FIG. 6 is a fragmentary view illustrating in detail one of the inclined water-dispersing members illustrated in FIG. 5;

FIG. 7 is a view similar to that of FIG. 6, but showing another embodiment of the invention, wherein each of the water-dispersing members is provided with a narrow, upstanding gusset or fillet portion serving to inhibit hang-up of loose stringy type debris on the water-dispersing members;

FIG. 10 is a fragmentary perspective view illustrating a portion of the water distribution and fill structure of a counterflow tower, with the distribution nozzles of the present invention affixed to and depending from the delivery mains of the tower;

FIG. 11 is a schematic, fragmentary view illustrating a crossflow water cooling tower with crossflow nozzles of the present invention as depicted in FIG. 8 being mounted within the basin floor of the tower; and FIG. 12 is a fragmentary, enlarged view depicting the FIG. 8 crossflow type nozzle mounted in the basis floor of the crossflow tower, and with exemplary fill structure beneath the nozzle assembly.

DESCRIPTION OF THE PREFERRED EMBODIMENTS

Figure 9:
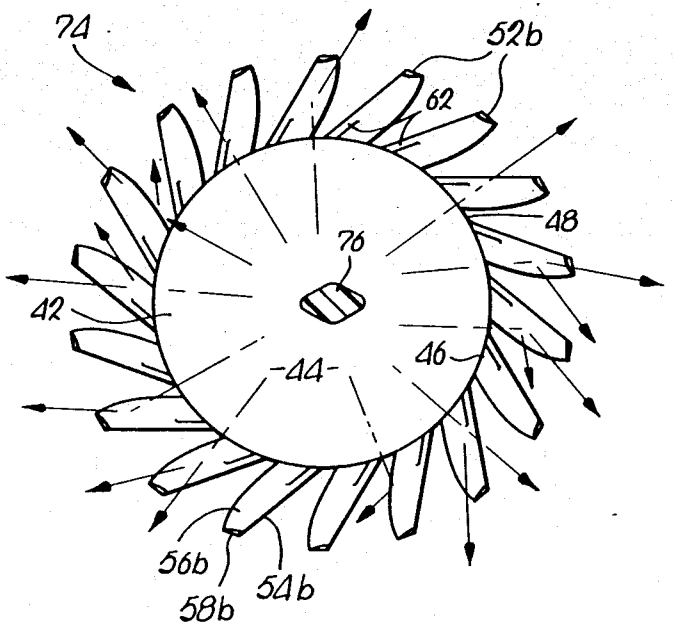
FIG. 9 is a sectional view illustrating the target structure forming a part of the embodiment illustrated in FIG. 8, with arrows showing exemplary paths of water droplets as they are dispersed by the target structure.

Turning now to the drawings, a nozzle assembly 20 particularly adapted for use in connection with counterflow water cooling towers is illustrated in FIGS. 1 and 2. Broadly speaking, the assembly 20 includes upper water metering means referred to by the numeral 22, water-dispersal means 24 in spaced relationship directly below the metering means 22, and connecting structure in the form of an elongated, arcuate arm 26 interconnecting the metering means 22 and water dispersal means 24.

In more detail, the metering means 22 is in the form of an elongated, synthetic resin tubular fitting or nipple 28 having a threaded upper end 30 and a flanged lowermost end 32. The lower end 32 defines a circular in cross section metering orifice 34 (see FIG. 1)

The nipple 28 is designed to threadably mate and be secured to a depending, complementary threaded connector 36. The latter is in turn fixed to the underside of a counterflow water conveying main or pipe 38 which is apertured as at 40. As will be readily appreciated, water flowing through pipe 38 passes downwardly through aperture 40, nipple 28 and ultimately out of orifice 34. The provision of the elongated, tubular nipple 28 assures that flow of water from the orifice 34 will be in a generally axial direction, i.e., a stream of water is created which is essentially parallel to the longitudinal axis of nipple 28.

The water-dispersal means 24 is likewise formed of synthetic resin and includes a central section in the form of an upstanding water dispersal element 42. This element presents an uppermost, generally conical, downwardly and outwardly diverging water contacting surface 44 which terminates in and defines an outer, lower, generally circular in plan configuration marginal edge 46. A depending, cylindrical skirt 48 extends downwardly from edge 46 as shown.

The overall water-dispersal target structure further includes a plurality of elongated, stationary, water-dispersing members or fingers 52 which are integral with and extend outwardly from skirt 48. Each of these members 52 is identical and includes an upright, rectilinear trailing surface 54 as well as an arcuate in cross section water-dispersal surface 56. The latter is of compound arcuate configuration, i.e., it is curved both longitudinally and transversely with respect to the longitudinal axis of the member. The outermost end 58 of each member is in the form of a blunt surface as depicted.

Referring particularly to FIG. 2, it will be seen that each of the members 52 is oriented such that the longitudinal axis thereof lies in a vertical plane which intersects the circle defined by marginal edge 46. Each of these planes is moreover non-radial, i.e., the plane does not pass through the center of the noted circle. Finally, it will be seen that the outer ends 58 of the respective members 52 lie in and cooperatively define an outer circle having a relatively large diameter.

In particularly preferred forms of the invention, the respective members 52 are each spaced a slight distance vertically below the edge 46. Such spacing is referred to by the numeral 60 in FIG. 1.

In order to enhance the operational efficiency of the nozzle assemblies 20, it has been found that certain dimensional relationships should advantageously be observed. Attention is specifically directed to FIG. 3 which is a schematic representation of the metering section 22 and water dispersal means 24. It will be seen that the diameter of orifice 34 has been labeled "Z", whereas the angle of inclination of the water contacting surface 44 has been denominated "theta." In terms of the preferred dimensional relationships in the assembly 10 therefore, it has been found that the diameter of the circle defined by marginal edge 46 should be up to about eight times the diameter of the orifice 34. At a minimum, this diameter should be as great as the orifice diameter. On the other hand, the diameter of the imaginary circle cooperatively defined by the outer ends 58 of the respective members 52 should be up to about ten times the diameter of the orifice. The angle theta, at least in the region immediately above marginal edge 46, should be in the range of from about 30 to about 45 degrees. As shown, it is most preferred that this angle theta be constant throughout the entire height of the surface 44. The slight vertical distance 60 (referred to as "Y" in FIG. 3) should preferably be at least about $\frac{1}{8}$ inch and would typically range from about $\frac{1}{8}$ to about $\frac{3}{8}$ inch. Finally, the distance Z' set forth in FIG. 3, or the shortest distance between the uppermost point of the surface 44, and the orifice-presenting end 32, should be at least equal to (and preferably greater than) the diameter of orifice 34.

Attention is next directed to FIGS. 5 and 6 which disclose a second embodiment in accordance with the invention, wherein a water-dispersing target structure 24*a* is provided. This target structure is in all respects identical with that previously described, save for the fact that the members 52*a* thereof are oriented at a slightly upwardly tilted angle, here about 10°. For ease of review, identical structure shown in the embodiment of FIGS. 1 and 2 and FIGS. 5–6 are identified by identical reference numerals, whereas differently configured parts are numbered using the appropriate numeral with the "a" designator.

FIG. 7 illustrates yet another embodiment of the invention, which is identical in most respects with the second embodiment but differs in that each of the members 52*b* includes an upper, thin fillet or gusset 62 which extends upwardly from the upper surface of the element to the marginal edge 46. The purpose of this structure is to eliminate any region where stringy materials within the cooling water may hang up on the water-dispersing members.

FIG. 10 illustrates a portion of a counterflow water cooling tower employing the nozzles of the present invention. That is to say, the illustration of FIG. 10 depicts the usual structural supports 64 for the tower fill and water distribution system, along with a film-type fill structure 66, plural water mains 38 of the type described previously situated above the fill structure, and a drift eliminator 68 situated above the fill and piping structure. Each of the pipes 38 includes a plurality of nozzle assemblies 20 affixed to the underside thereof, as depicted in detail in FIG. 1. As those skilled in the art will readily appreciate, water delivered through the pipes 38 is passed downwardly through the respective nozzle assemblies 20, for dispersal onto the fill structure. Counterflowing air is simultaneously drawn upwardly through the fill in direct, opposed relationship to the gravitating water, in order to achieve evaporative cooling of the latter. The cooled water is then collected in a lower cold water basin (not shown) for reuse.

Figure 8:
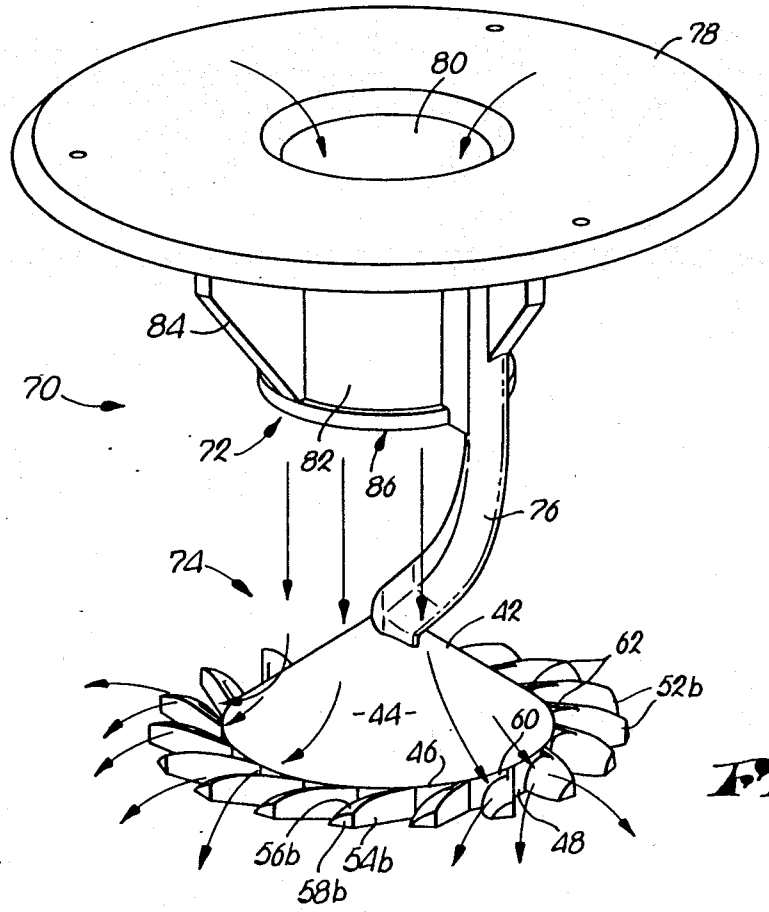
FIG. 8 illustrates another embodiment of the invention designed for use in crossflow type towers.

Attention is next directed to FIGS. 8 and 9 which illustrate a preferred synthetic resin nozzle assembly 70 for use in a crossflow water cooling tower. Here again, in broad aspect the assembly 70 includes an upper water metering section 72 and a lower water dispersal target 74. These two components are interconnected by means of arcuate arm 76 as illustrated. The upper section 72 includes a radially enlarged, essentially flat upper flange 78 which is centrally apertured as at 80. A depending, tubular nipple 82 is secured to the underside of flange 78 in registration with aperture 80. A plurality of circumferentially spaced reinforcing fins 84 serve to interconnect the nipple 82 with flange 78, as will be readily appreciated. The lowermost end of the nipple 82 serves to define a water delivery orifice 86. Moreover, provision of the nipple structure above the outlet orifice 86, together with aperture 80, assures creation of an axial, downwardly extending flow of water from the metering section 72. The lower water dispersal section 74 of the nozzle 70 is identical to that described in connection with FIG. 7. Hence, the structure 74 includes the conical element 42 presenting an uppermost, downwardly and outwardly diverging water contacting surface 44 terminating in a lower circular marginal edge 46. A depending skirt 48 extends downwardly from edge 46, whereas the slightly upwardly inclined members 52*b* are mounted on and extend outwardly from skirt 48. Each of the members 52*b* includes the upright trailing surface 54*b*, compound arcuate water-deflecting surface 56*b*, and outer end 58*b*. Moreover, it will be seen that the members 52*b* are oriented in a generally circular array, and each is provided with the upstanding, thin gusset portion 62 for the purposes described.

As indicated, the nozzle assembly 70 is designed for use in a crossflow water cooling tower, such as the tower 88 depicted in FIG. 11. The tower 88 includes an upper water distribution basin 90 provided with an apertured basin deck 92. Crossflow-type fill structure 94 is situated beneath basin 90, and may take the form of a plurality of arcuate in cross section spash bars 96 supported on an appropriate grid 98 (see FIG. 12). A lower cold water collection basin 100 is provided beneath the fill structure 94, and conventional drift eliminator structure 102 is located inboard of the fill structure 94, as those skilled in the art will readily appreciate. The tower depicted in FIG. 11 is of the mechanical draft variety, and accordingly a powered fan 104 is provided for inducing ambient-derived air currents to pass in a generally lateral fashion through the fill structure 94, so as to come into intersecting, evaporatively cooling relationship with descending hot water from basin 90.

As shown in FIGS. 11 and 12, the deck 92 is fitted with a plurality of the crossflow-type nozzle assemblies of the invention. The nozzles illustrated in FIGS. 11 and 12 are identical with the assembly 70 depicted in FIGS. 8 and 9, except that the target structures illustrated do not include upwardly oriented members 52*b;* rather, the target structure illustrated in this embodiment are of the type depicted in FIGS. 1, 2 and 4. Accordingly, the overall nozzle assemblies illustrated in FIGS. 11 and 12 have been labeled as "70*a*", and all other parts have been appropriately numbered.

In the operation of any of the nozzle assemblies in accordance with the invention, water is initially directed through the upper metering section thereof so as to create the desired downward, essentially axial stream of water. This water stream then impinges upon the lower water-dispersing target structure, with the effect that water is very effectively dispersed into droplets over a relatively large area, both directly beneath and around the nozzle assembly. Various water paths characteristic of the invention are illustrated in FIGS. 8 and 9, by means of arrows. It will of course be appreciated that a large number of such paths are actually generated in practice, with the effect that water is widely dispersed for enhanced cooling purposes.

Moreover, when use is made of the preferred dimensional relationships described above (which apply equally to those embodiments wherein the water-dispersing fingers or members are essentially horizontal or inclined upwardly), the nozzle assemblies are capable of safely passing large debris which may be encountered in the use of unfiltered cooling water. As such, the invention meets the twin objectives of providing enhanced cooling, while at the same time clearing large debris.

It will also be seen that the nozzle assemblies of the invention can, with appropriate modification, be used equally well on counterflow or crossflow type towers. This is a decided advantage, particularly in the context of tower reconstructions where the large expense associated with repiping can be avoided.

I claim:

1. A liquid distribution assembly for use in water cooling towers and comprising:

water metering means including structure presenting a metering orifice of predetermined diameter, and means for delivery of water in a generally axial manner from the orifice; and means below said orifice for dispersing and increasing the effective surface area of the water delivered from the orifice in order to enhance cooling of the water, said water-dispersing means including a water dispersing element having an upstanding, downwardly and outwardly diverging, generally tapered water-contacting upper surface and presenting an outer, lower, generally circular in plan configuration marginal edge, the diameter of said element surface at said marginal edge being approximately equal to or greater than said orifice diameter and no more than about eight times said orifice diameter, the angle of inclination of said water-contacting surface at the area thereof immediately above said marginal edge being from about 30° to about 45° with respect to the horizontal;

a plurality of elongated, stationary water-dispersing members each presenting an elongated, arcuate in cross-section water-engaging surface, an inner end and an opposed outer end; and said members being mounted adjacent to and extending outwardly from said element marginal edge and in a substantially circular array, with the longitudinal axis of each member lying in a vertical plane intersecting the circle defined by said element marginal edge and without passing through the center of such circle, the outer ends of said members lying in and cooperatively defining a circle having a relatively large diameter, the diameter of said member-defined circle being up to about ten times greater than said orifice diameter.

2. The assembly of claim 1, at least a portion of the inner end of each of said members being spaced a slight distance vertically below said element marginal edge.

3. The assembly of claim 2, said distance being at least about $\frac{1}{8}$ inch.

4. The assembly of claim 2, each of said members including a thin upstanding gusset portion extending upwardly to said element marginal edge.

5. The assembly of claim 1, the shortest distance between the uppermost point of said water-contacting surface and said orifice-presenting structure being at least about equal to said orifice diameter.

6. The assembly of claim 1, said metering means including an elongated, tubular, depending, water-conveying body, the lowermost margin of said body presenting said orifice.

7. The assembly of claim 1, the longitudinal axes of said members being oriented in a horizontal plane.

8. The assembly of claim 1, the longitudinal axes of said members each being oriented at an angle with respect to the horizontal.

9. The assembly of claim 1, said water metering means including an uppermost, radially enlarged, apertured flange, an elongated, tubular, water-conveying body secured to and depending from said flange and in alignment with said flange aperture, the lowermost margin of said body presenting said orifice.

10. The assembly of claim 1, including an arm interconnecting said metering means and water-dispersing means.

11. The assembly of claim 1, the angle of inclination of said water-contacting surface being constant throughout the height of said element.

* * * * *